United States Patent [19]

Schneider et al.

[11] 4,149,388

[45] Apr. 17, 1979

[54] PORTABLE CRYOGENIC POWER SYSTEM FOR PNEUMATICALLY OPERATED TOOLS

[76] Inventors: Richard N. Schneider, P.O. Box 610, Reno, Nev. 89504; Thomas T. Cafferty, 225 E. Pedregosa St., Santa Barbara, Calif. 93101

[21] Appl. No.: 790,785

[22] Filed: Apr. 25, 1977

[51] Int. Cl.[2] ..... F17C 7/02

[52] U.S. Cl. ..... 62/50; 62/52; 62/514 R

[58] Field of Search ..... 62/50, 52, 53, 514 R, 62/51

[56] References Cited

U.S. PATENT DOCUMENTS

| | | | |
|---|---|---|---|
| 1,417,292 | 5/1922 | Andrews | 62/52 |
| 2,286,050 | 6/1942 | Baker et al. | 62/52 |
| 2,454,934 | 11/1948 | Mathis et al. | 62/50 |
| 2,553,486 | 5/1951 | Thomas | 62/50 |
| 2,683,484 | 7/1954 | Falligant | 62/50 |
| 2,884,943 | 5/1959 | Dobrick | 62/52 |
| 2,951,348 | 9/1960 | Loveday et al. | 62/50 |
| 3,007,596 | 11/1961 | Matsch | 62/50 |
| 3,174,294 | 3/1965 | Lawrence | 62/52 |
| 3,199,303 | 8/1965 | Haumann et al. | 62/50 |
| 3,318,307 | 5/1967 | Nicastro | 62/52 |
| 3,578,753 | 5/1971 | Freeman | 62/52 |
| 3,886,733 | 6/1975 | Connell | 62/52 |

*Primary Examiner*—Carlton R. Croyle
*Assistant Examiner*—Thomas I. Ross
*Attorney, Agent, or Firm*—Townsend and Townsend

[57] ABSTRACT

A compact, lightweight, portable cryogenic system for powering small pneumatic hand tools. A unitary manifold for providing a fluid fill path and a fluid vent path is mounted to the upper surface of a small dewar for containing a cryogenic liquid under pressure. The manifold is provided with partially threaded inner passageways for externally mounting a vent valve, pressure gauge and first relief valve, and for internally mounting a fill check valve and an economizer check valve. The economizer check valve is coupled to the inlet of a small heat exchanger comprising a length of finned tubing coiled in a stack about the manifold on top of the dewar and prevents back-flow of fluid to the dewar. A pneumatic circuit breaker valve coupled between the outlet of the heat exchanger and the inlet of a pneumatic hose having a disconnect valve at the outlet enables small pneumatic hand tools to be removably connected to the pneumatic hose and powered by cryogenic liquid vaporized in the heat exchanger. The pneumatic circuit breaker valve limits the flow rate of cryogenic vapor to the tool to a predetermined maximum, and a second relief valve coupled between the heat exchanger outlet and the circuit breaker valve limits pressure build-up in the heat exchanger to a predetermined maximum.

A shroud having handle portions for carrying the unit is secured to the upper peripheral portion of the dewar with a fluid clearance between the lower edge of the shroud and the upper surface of the dewar periphery so that the ambient air freely flows past the heat exchanger.

16 Claims, 6 Drawing Figures

PORTABLE CRYOGENIC POWER SYSTEM FOR PNEUMATICALLY OPERATED TOOLS

BACKGROUND OF THE INVENTION

This invention relates to systems used to power pneumatically operated tools. More particularly, this invention relates to systems of the above type for supplying a pressurized gas as a power source for such tools.

Pneumatic power sources are known which are utilized to provide a gas under pressure to a variety of pneumatically operated tools, such as screwdrivers, impact wrenches, air chisels, nailers and the like. Portable pneumatic power sources of the above type generally fall into one of two classes: devices consisting of a container for holding gas such as carbon dioxide under relatively high pressure and associated valving equipment; and devices having the container, valving equipment, and a small compressor operated by a motor, such as a diesel engine. Devices of the first class are typically constructed with relatively thick walls for the container in order to ensure against bursting of the container under the relatively high pressure of the gas stored therein, and are thus relatively heavy, which impairs their portability. Devices of the remaining class are typically mounted on a mobile cart which must be towed by an automotive vehicle, and are thus not truly portable but rather mobile. In addition, such devices require a fuel tank for containing the fuel used to power the motor or engine and thus cannot be used in some environments where the danger of explosion or fire is great. Further, when operating, the motor or engine produces noise and smoke which are at best inconvenient to passers by and at worst completely intolerable in certain environments.

In both classes of device, long pneumatic hoses are required in order to afford the necessary freedom of movement to the operator of the portable pneumatic hand tool to which the power source is connected. For example, when such power sources are used in conjunction with a pneumatic stapling tool for installing or replacing shingles on the roof of a structure, the connecting pneumatic hoses must be sufficiently long to permit the operator to climb a ladder and reach the most remote extremity of the roof. Hoses of such length, however, are extremely cumbersome to manipulate, particularly from a roof location, and thus impair the efficiency of the operator. Similar disadvantageous constraints apply with equal force to other applications of such pneumatic power sources.

Another disadvantage inherent in prior art pneumatic power sources resides in the fact that the working gas must be stored in the container at relatively high pressures in order to reduce the physical size of the container to a manageable size. This in turn requires a pressure regulator between the container and the pneumatic tool, which is designed to operate at a relatively low pressure, e.g. 100 psig. Such pressure regulators have been known to fail on not infrequent occasions, with the result that the companion tool is damaged or destroyed, sometimes with injury resulting to the operator.

Efforts in the past to devise a portable pneumatic power source devoid of the above limitations or disadvantages have not been successful to date.

SUMMARY OF THE INVENTION

The invention comprises a safe, efficient portable pneumatic power source which is extremely light in weight, compact, inexpensive and simple to use, and which employs a cryogenic fluid stored under a relatively low pressure as the power source.

In the preferred embodiment, a dewar capable of containing a predetermined quantity of a liquid cryogen at a relatively low pressure is coupled via a check valve to a first end of a compact heat exchanger for vaporizing cryogenic liquid supplied thereto in response to demand from the tool. The remaining end of the heat exchanger is coupled via a pneumatic circuit breaker valve to a flexible pneumatic hose having a quick disconnect pneumatic valve coupled at the other end thereto and to which a portable hand tool is adapted to be connected.

The dewar is provided with an inner vessel and an outer vessel, each having a central opening at the upper portion thereof, and an insulative layer in the volume between the inner and outer vessels. In addition, a neck portion is connected between the inner and outer vessel central openings in sealing engagement therewith. A flange is secured to the upper portion of the outer vessel for providing mechanical support for a fluid manifold which provides several different fluid paths described below. A vent tube and a fill tube, each extending a predetermined distance into the interior of the inner vessel, are secured to a bottom surface of the fluid manifold in communication with a vent fluid path and a fill fluid path, respectively. The fill fluid path includes an inlet adapted to be connected to an external supply of cryogenic liquid, and a check valve for preventing escape of cryogenic fluid from the inner vessel via the fill tube and fill inlet. The vent fluid path includes a pressure gauge for indicating the vaporization pressure within the inner vessel, a pressure relief valve for preventing excess vapor pressure build-up in the inner vessel, and a vent valve for enabling depressurization of the system for disassembly, repair or storage.

Connected to the fill fluid path between the fill check valve and the fill tube is an economizer check valve which permits unidirectional flow of the cryogenic liquid to the inlet end of the heat exchanger. The heat exchanger preferably comprises a coiled length of finned tubing arranged about the fluid manifold and surrounded by a protective shroud provided with handle means for enabling the unit to be manually transported.

A second relief valve is positioned between the outlet of the heat exchanger and the inlet of the pneumatic circuit breaker valve for preventing excess pressure build-up in the heat exchanger. The release pressure of the second relief valve is set at a slightly higher value than the release pressure of the first relief valve in communication with the vent fluid path.

A pressure relief valve comprising a flanged metal plug and an O-ring is received in an aperture in the outer vessel to provide pressure relief in the event of a rupture of the inner vessel.

In use, the inner vessel is filled with a cryogenic liquid via the fill check valve and the fill tube with the vent valve open. After the cryogenic liquid has filled the inner vessel to approximately 85 to 90% of the inner vessel volume, the vent valve is closed and the fill fluid path is disconnected from the external source of cryogenic fluid. After filling, the system is pressurized by simply tipping the dewar so that the cryogenic liquid in the inner vessel encounters the exposed portion of the bottom surface of the fluid manifold, access being provided by the neck portion of the dewar, so that the cryogenic liquid is placed in thermal contact with ambient. The thermal contact results in vaporization of a portion of the cryogenic liquid and a resulting increase in pressure within the inner vessel until the designed operating pressure is reached. At this time, the first relief valve opens, which signifies that the system is ready to be used.

During system operation, a pneumatic tool is connected to the pneumatic hose by means of the quick disconnect fitting, which is normally closed when disconnected. When the demand valve on the pneumatic tool is activated thereafter, the fluid pressure within the heat exchanger drops and the economizer check valve opens, due to the higher fluid pressure upstream therefrom. Cryogenic liquid then flows through the heat exchanger where it is vaporized and warmed to near ambient temperature. From the heat exchanger, the warmed gas flows through the pneumatic circuit breaker valve and through the pneumatic hose and quick disconnect valve to the pneumatic tool. Should the volumetric flow rate of the gas in the pneumatic hose exceed the predetermined upper limit, the circuit breaker valve automatically closes, which prevents further fluid flow into the pneumatic hose. By this arrangement, excess pressure drop within the inner vessel is avoided. In addition, the pneumatic circuit breaker valve protects the user from being sprayed by cryogenic liquid should the pneumatic hose rupture.

The economizer check valve serves to minimize working fluid waste which would otherwise occur as a result of the transient nature of the heat transfer process.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
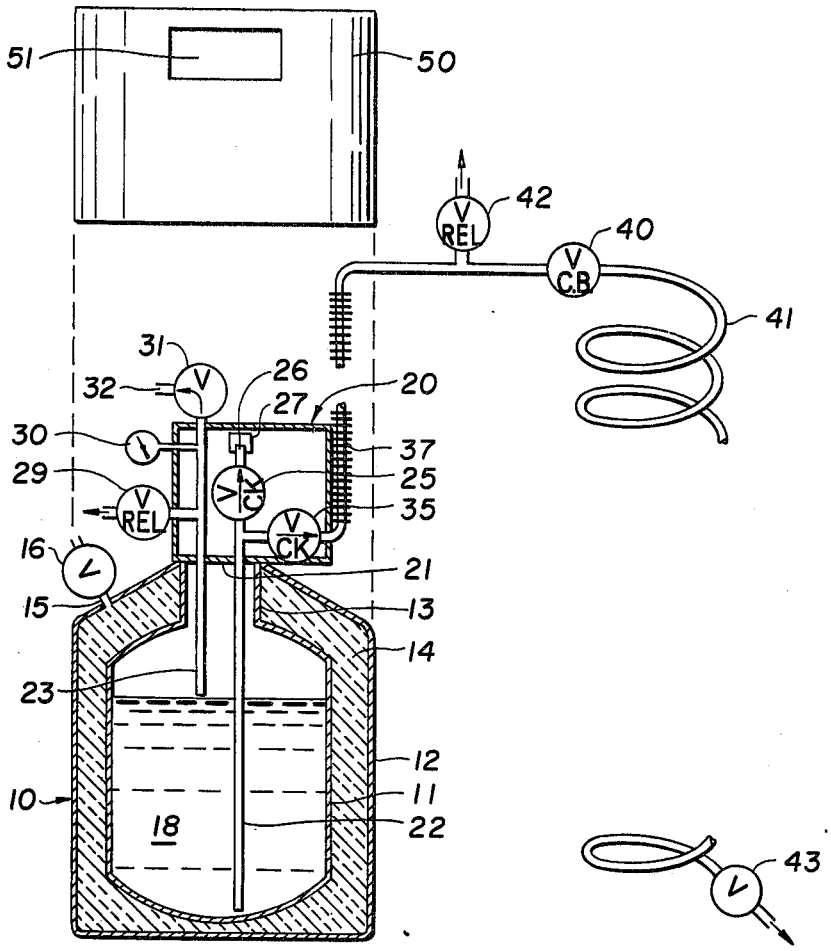
FIG. 1 is a schematic system diagram illustrating the invention.

Turning now to the drawings, FIG. 1 is a schematic system diagram illustrating the invention. As seen in this figure, a dewar generally designated by reference numeral 10 includes an inner vessel 11, an outer vessel 12, a neck portion 13 and a quantity of insulative material 14 located in the volume between the inner and outer vessels 11, 12. Outer vessel 12 is provided with a through aperture 15 and a safety valve 16 designed to relieve pressure from within the dewar 10 in the event that inner vessel 11 should rupture while pressurized.

Secured to the upper end of dewar 10 is a fluid manifold generally designated by reference numeral 20 and having a lower surface 21, a portion of which is exposed to the interior of neck portion 13 of dewar 10. Extending downwardly from manifold 20 are a fill tube 22 and a vent tube 23. Fill tube 22 terminates at the lower end adjacent the inner bottom surface of inner vessel 11; vent tube 23 terminates at the lower end thereof at such a height from the bottom inner surface of inner vessel 11 that the upper surface of cryogenic liquid 18 reaches the lower end of vent tube 23 when inner vessel 11 has been filled to between 85% and 90% capacity. Fill tube 22 is connected to the outlet side of a check valve 25, the inlet side of which is coupled to a fluid fill inlet 26 provided with a removable cap 27. Check valve 25 permits fluid to flow from inlet 26 to fill tube 22 when the inlet 26 is coupled to an external supply of cryogenic liquid under pressure.

Vent tube 23 is coupled to a relief valve 29 which provides pressure relief for vaporized liquid within inner vessel 11, and which is set to a release pressure in the range from about 90 to about 110 pounds per square inch gauge (psig). Vent tube 23 is also coupled to a pressure gauge 30 which enables an operator to visually monitor the system pressurization. Vent tube 23 is also coupled to a manually operable vent valve 31 having an outlet 32 to permit venting of inner vessel 11 to ambient.

Fill tube 22 is also coupled to the inlet of a check valve 35, hereinafter designated as economizer check valve 35, the outlet of which is coupled to the inlet of a heat exchanger 37. Economizer check valve 35 permits the flow of cryogenic liquid from inner vessel 11 through fill tube 22 into heat exchanger 37 whenever the system is pressurized and a pressure drop occurs downstream from valve 35.

The outlet of heat exchanger 37 is coupled to the inlet of a pneumatic circuit breaker valve 40 of conventional construction, the outlet of which is coupled to a pneumatic hose 41. The outlet of pneumatic hose 41 is coupled to the inlet of a quick disconnect valve 43 of conventional construction which is normally closed and which automatically opens whenever the inlet of a pneumatic tool is coupled thereto.

A relief valve 44 is also coupled to the outlet of heat exchanger 37 and is set to release at a pressure in the range from about 125 to about 140 psig.

A cylindrical shroud 50 having at least one handle aperture 51 formed therein is mechanically secured to the outer perimeter of the upper surface of outer vessel 12 and provides protection for the several elements surrounded thereby against accidental damage during handling.

In use, dewar 10 is filled in the following manner. Vent valve 31 is first opened, cap 27 is removed from fluid fill inlet 26 and a source of cryogenic liquid under pressure is connected to fluid fill inlet 26. The cryogenic liquid flows through check valve 25 and fill tube 22 into the interior of inner vessel 11 until the fluid 18 reaches the lower end of vent tube 23. Any attempt to overfill inner vessel 11 results in the egress of the cryogenic liquid 18 via vent tube 23, vent valve 31 and outlet 32. Once the inner vessel 11 has been filled to between 85% to 90% of capacity, the remote source of cryogenic liquid is disconnected from inlet 26, after which vent valve 31 is closed. Check valve 25 prevents the escape of any cryogenic liquid through inlet 26. The unit may now be stored for use in connection with a pneumatic hand tool.

When the unit is ready for use in the field, it is pressurized initially in the following fashion. Dewar 10 is tilted until fluid 18 contacts the exposed portion of lower surface 21 of manifold 20 which is at ambient temperature. This contact results in the transfer of heat to cryogenic liquid 18, with the result that a portion of liquid 18 is vaporized, thereby causing an increase in pressure in the volume of inner vessel 11 above the upper surface of the liquid 18. The pressure rise continues until the release pressure of relief valve 29 is attained. Any further increase will be automatically vented by relief valve 29, and this can serve as a signal that the unit is ready for operation. Alternatively, the pressurization of the system can be viewed by the operator by observing pressure gauge 30.

Once pressurized, a pneumatic hand tool is attached to quick disconnect valve 43, thereby opening this valve, after which the trigger valve on the pneumatic hand tool (not shown) can be opened. In response to the opening of the pneumatic tool trigger valve, a pressure drop occurs in pneumatic hose 41 and check valve 35 opens, thereby permitting cryogenic liquid 18 to flow from inner vessel 11 upwardly through fill tube 22, through check valve 35 and into heat exchanger 37. As the liquid 18 flows through heat exchanger 37, heat is transferred from ambient to the liquid 18, causing the liquid to vaporize and flow through circuit breaker valve 40, pneumatic hose 41, valve 43 and thence to the pneumatic hand tool to operate the latter. When the pneumatic hand tool trigger valve is closed by the operator, a pressure build-up occurs downstream of check valve 35, thereby causing this element to close. Any cryogenic liquid located within heat exchanger 37 will continue to vaporize in response to the ingress of heat from ambient, and a pressure build-up occurs between economizer check valve 35 and quick disconnect valve 43. Should this pressure exceed the set pressure of relief valve 42, the latter element automatically opens to maintain the pressure of this portion of the system within predetermined safety ranges.

As the amount of cryogenic liquid 18 in inner vessel 11 is reduced by operator demand, it is necessary to maintain the vapor pressure above the surface of liquid 18. This is accomplished according to the invention by designing the insulating material 14 in such a lossy fashion as to permit a small amount of heat transfer from ambient into inner vessel 11. In addition, the physical size of neck 13 is made larger than the size which would ordinarily be required by purely structural constraints in order to increase the "heat leak" from ambient to inner vessel 11.

Figure 2:
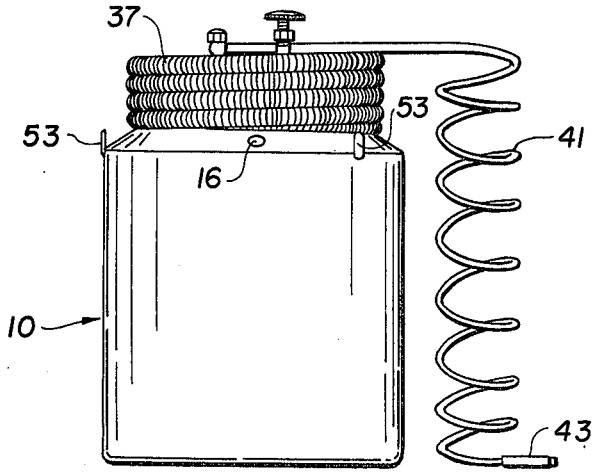
FIG. 2 is a side elevational view of the preferred embodiment with the shroud removed.
Figure 3:
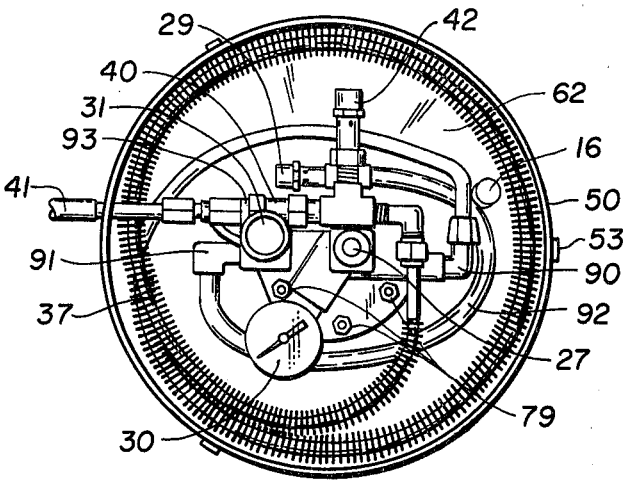
FIG. 3 is a top plan view of the device of FIG. 2, showing the shroud installed.

FIGS. 2–6 illustrate in detail the best mode contemplated of practicing the invention. As best shown in FIGS. 2 and 3, fluid manifold 20 and the elements associated therewith are positioned centrally of the upper end of dewar 10, and heat exchanger 37 is coiled and stacked about these elements. As best shown in FIG. 2, a plurality of lugs 53 are secured to the upper outer periphery of dewar 10 at spaced locations in order to provide a fastening means for shroud 50 (omitted for clarity from FIG. 2). Shroud 50 may be fastened to lugs 53 by any suitable means, e.g. rivets, threaded fasteners, or the like.

Figure 5:
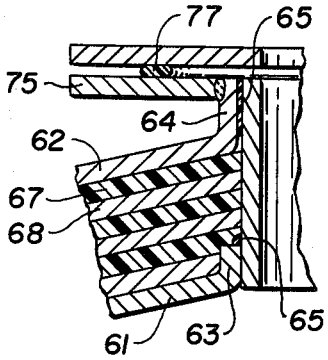
FIG. 5 is an enlarged sectional view showing details of the dewar construction.
Figure 4:
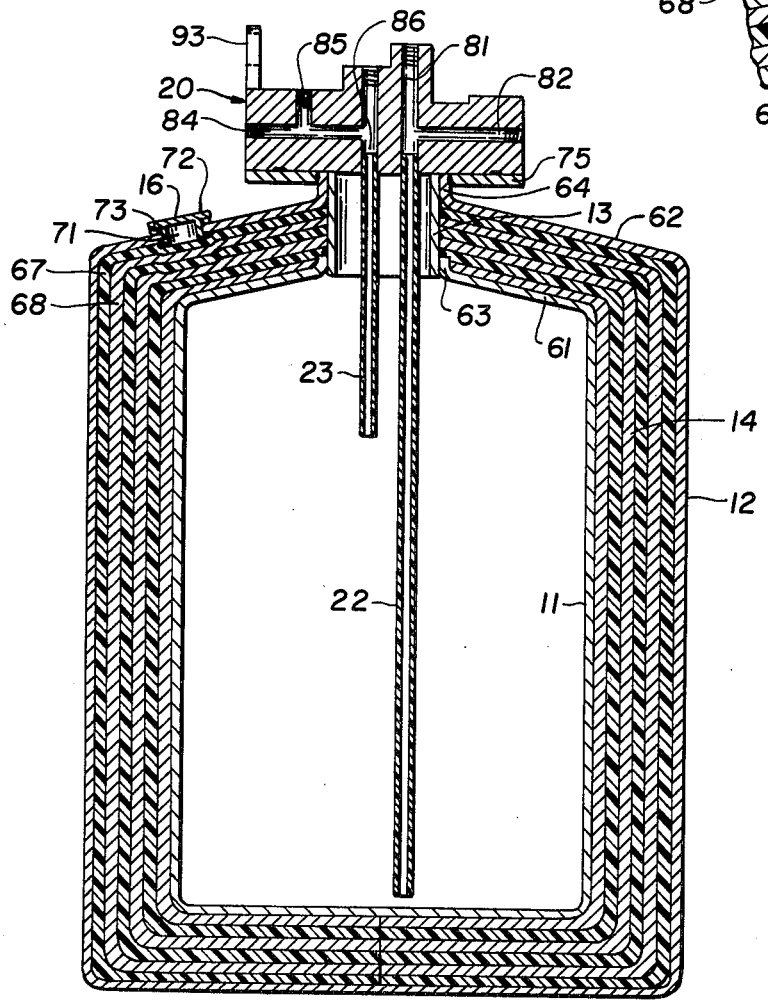
FIG. 4 is a sectional view showing the dewar and fluid manifold.

The structure of dewar 10 may best be understood by reference to FIGS. 4 and 5. With reference to these figures, inner vessel 11 and outer vessel 12, preferably fabricated from aluminum or stainless steel, are each provided with a sloping upper wall portion 61, 62, respectively, each terminating in a centrally located upturned rim 63, 64, respectively. Neck portion 13 of dewar 10 comprises a substantially cylindrical element, preferably fabricated from fiberglass, which is received within rim portions 63, 64 and secured thereto by a suitable adhesive, preferably epoxy resin 65. Insulation 14 arranged within the volume between inner vessel 11 and outer vessel 12 preferably comprises alternate layers of aluminized Mylar 67 and fiberglass spacer material 68. Relief valve 16 comprises a plug having a central body portion 71 received within aperture 15, a flanged cap portion 72 and an O-ring 73 received about central body portion 71.

Secured about the upper end of rim portion 64 by welding is a flange 75 for supporting manifold 20. A fluid sealing element 77, preferably fabricated from Teflon, is positioned between the upper surface of flange 75 and the lower surface of manifold 20. Manifold 20 is secured to flange 75 by suitable fasteners such as the bolts depicted in FIG. 3.

Fill tube 22 and vent tube 23 are preferably hollow fiberglass tubes which are secured to the underside of manifold 20.

Figure 6:
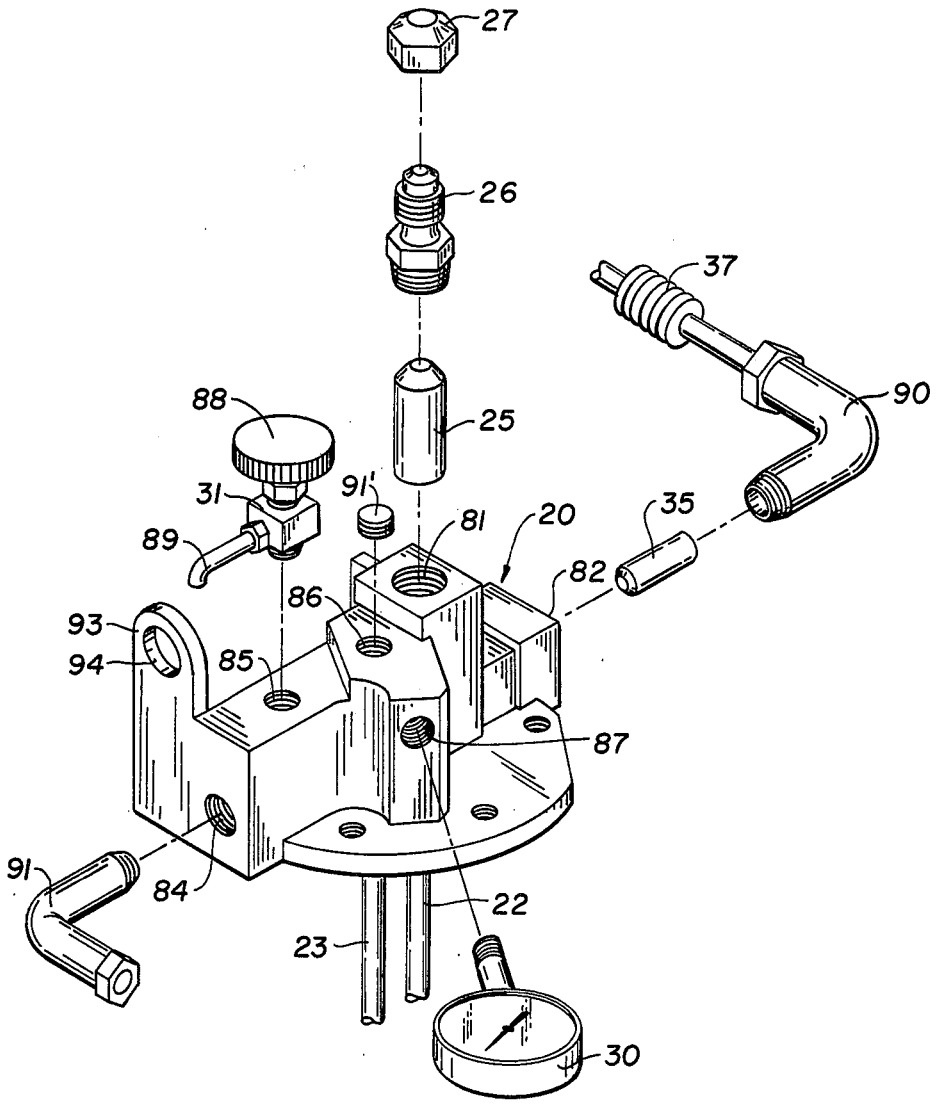
FIG. 6 is an exploded view showing the fluid manifold and associated elements.

With reference to FIGS. 3, 4, and 6, manifold 20 comprises a unitary block fabricated from a substance having a relatively high coefficient of thermal conductivity, e.g. a metal such as aluminum or stainless steel, and is provided with internal passageways for establishing the required fluid paths. For example, a first fluid conduit 81 extends from the upper to the lower surface 21 of manifold 20 to provide the fill fluid path, with conduit 81 having a branch 82 extending to the right as viewed in FIG. 4 to provide a fluid outlet to the heat exchanger 37. A second conduit 84 is concert with branches 85 and 86 provides a vent fluid path, and the left-most portion of conduit 84 provides a fluid path to externally mounted relief valve 29. As best seen in FIG. 6, a tapped bore 87 is also formed in manifold 20 which communicates with conduit 86 and affords mechanical and fluid connection for a conventional pressure gauge 30. Similarly, conduit branch 85 is internally threaded to receive a conventional vent valve 31 having a manually operable handle 88 and spout 89. The upper portion of conduit 81 is also internally threaded and counterbored to receive conventional check valve 25 and externally threaded inlet fitting 26. Branch 82 is also threaded and counterbored to receive economizer check valve 35 and a threaded elbow fitting 90 to which heat exchanger 37 is secured. Conduit 86 is also threaded at the upper portion to receive a fluid sealing plug 91', while conduit 84 is internally threaded to receive elbow 91. A hose 92 interconnects elbow 91 and relief valve 29. (FIG. 3).

Manifold 20 is also provided with an upstanding tab portion 93 having an aperture 94 for receiving a fitting associated to pneumatic circuit breaker 40 for structural mounting purposes.

As noted above, the upper wall portion of outer vessel 12 is provided with a sloping contour and lugs 53 for mounting shroud 50. Shroud 50 is preferably mounted to dewar 10 in such a fashion that an air gap exists between the lower edge of shroud 50 and the outer perimeter of upper wall portion 62 in order to facilitate the flow of ambient air past heat exchanger 37. Heat exchanger 37 is preferably fabricated from finned metal tubing, e.g. aluminum, and in the preferred embodiment consists of a twelve foot length of such tubing arranged in a coil whose inner diameter is sufficiently great to accomodate manifold 20 and the elements associated thereto, while the outer diameter thereof is less than the inner diameter of shroud 50.

Cryogenic power sources fabricated in accordance with the teachings of the invention are designed for use with small pneumatic hand tools. Typical of the types of pneumatic tools which can be powered by a system fabricated according to the invention are screwdrivers, impact wrenches, file grinders, nut setters, small drills, small riveters, nailers, staplers, small air chisels, and small spray guns. Although pneumatic tools of this type have continuous gas consumption rates in the range from about 5 to 30 cubic feet measured at standard conditions, the system is designed to provide an average continuous flow rate in the range from about 0.25 to about 1.0 cubic feet measured at standard conditions. By limiting the average continuous flow rate to this range, the heat exchanger may be kept relatively small and light in weight, and the extremely simple system pressurization arrangement described above may be employed without overrunning the system capabilities. The above flow rate range further ensures that the entire system is readily portable. For example, in a system having a dewar with an inner vessel of a seven liter capacity, the weight of the unit fully charged with liquid nitrogen is found to be only 23 pounds. Such a lightweight system can be readily manually transported to any work site.

While the invention has been described with specific reference to liquid nitrogen as the cryogenic fluid, other fluids may be employed, such as liquid air, liquid argon and liquified atmospheric gases in general. Such fluids are nonpolluting, readily obtainable in urban areas, and typically are much freer of particulate contaminant materials than conventional carbon dioxide pneumatic sources so that the pneumatic hand tools employed with the invention are less prone to disruptive clogging. It should be further noted that the relatively low pressurization of the cryogenic fluid permits the use of relatively thin-walled inner and outer vessels in dewar 10 without lessening system safety from accidental rupture of dewar 10, which is an added advantage.

While the above provides a full and complete disclosure of the preferred embodiment of the invention, various modifications, alternate constructions and equivalents may be employed without departing from the true spirit and scope of the invention. Therefore, the above description and illustrations should not be construed as limiting the scope of the invention which is defined by the appended claims.

What is claimed is:

1. A portable cryogenic power system for use with pneumatic tools, said system comprising:

insulative tank means for storing a cryogenic fluid in a liquid state at relatively low pressure, said tank means having an interior with a bottom surface and an aperture providing fluid communication with said interior, said tank means including an inner vessel and an outer vessel each provided with an aperture, neck means for providing a fluidtight connection between said inner vessel aperture and said outer vessel aperture, and lossy insulation means positioned between said inner vessel and said outer vessel for hindering the flow of heat from ambient to said interior of said tank means, said tank means further including an outer wall surface and a top surface joined to the upper periphery of said outer wall surface to define an upper peripheral edge thereof;

manifold means coupled to said tank means for providing a fill path and a vent path to said interior of said tank means, said manifold means being fabricated from a material having a relatively high coefficient of thermal conductivity and including a fill inlet, a vent outlet, a cryogenic working fluid outlet and a bottom surface portion in fluid communication with said interior of said tank means;

fill tube means having a first end coupled to said fill path of said manifold means and a second end extending into said interior of said tank means;

vent tube means having a first end coupled to said vent path of said manifold means and a second end extending into said interior of said tank means, said second end of said vent tube means terminating at a distance above said interior bottom surface of said tank means to provide a maximum fill capacity less than the total internal volume of said tank means;

first relief valve means coupled to said vent path of said manifold means for providing pressure relief to said interior to said tank means at a first release pressure;

vent valve means coupled to said vent outlet of said manifold means for enabling said interior to be vented to ambient;

check valve means coupled to said fill path for preventing fluid flow from said interior of said tank means to said fill inlet;

heat exchanger means for vaporizing cryogenic fluid flowing therethrough, said heat exchanger means having an inlet portion and an outlet portion;

economizer check valve means coupled to said cryogenic working fluid outlet of said manifold means and said inlet portion of said heat exchanger means for enabling one-way flow of said cryogenic fluid from said interior of said tank means to said heat exchanger means;

pneumatic circuit breaker valve means for limiting the flow of cryogenic fluid therethrough to a relatively low predetermined maximum rate, said pneumatic circuit breaker valve means having an inlet coupled to said heat exchanger outlet portion and an outlet adapted to be coupled to a pneumatic hose;

second relief valve means coupled to said heat exchanger outlet portion for providing pressure relief to said heat exchanger at a second release pressure greater than said first release pressure;

means including said bottom surface portion of said manifold means for vaporizing a portion of said cryogenic fluid in said interior of said tank means to provide a relatively low working pressure to said interior of said tank means for causing flow of cryogenic fluid from said interior through said economizer check valve means to said heat exchanger means; and shroud means having a lower end coupled to said insulative tank means adjacent said upper peripheral edge for providing a protective enclosure for said manifold means, said fill tube means, said vent tube means, said first and second relief valve means, said vent valve means, said check valve means and said economizer check valve means, said lower end of said shroud means being spaced from said top surface and said outer wall surface of said insulative tank means to provide communication between ambient and said heat exchanger means.

2. The combination of claim 1 wherein said insulative tank means includes a top wall and said aperture is located in said top wall.

3. The combination of claim 2 further including flange means secured to said top wall of said insulative tank means, said manifold means being coupled to said flange means.

4. The combination of claim 1 wherein said outer vessel is provided with a second aperture, and further including a third relief valve means coupled to said second aperture for providing a pressure relief path from the interior of said outer vessel to ambient in response to a rise in pressure therewithin of a predetermined magnitude.

5. The combination of claim 1 wherein said manifold means comprises an integral member.

6. The combination of claim 5 wherein said fill path and said vent path each comprises a separate conduit formed in said integral member, and said check valve means is received within said fill path conduit adjacent said fill inlet.

7. The combination of claim 6 wherein said vent outlet includes an internally threaded portion of said vent path conduit, and said vent valve means includes an externally threaded member engaged with said internally threaded portion.

8. The combination of claim 6 wherein said cryogenic working fluid outlet of said manifold means includes a portion of said fill path conduit, and said economizer check valve means is received within said portion of said fill path conduit.

9. The combination of claim 1 wherein said heat exchanger means comprises a length of externally finned tubing coiled about said manifold means.

10. The combination of claim 1 wherein said first release pressure is in the range from about 90 to about 110 pounds per square inch gauge.

11. The combination of claim 1 wherein said second release pressure is in the range from about 125 to about 140 pounds per square inch gauge.

12. The combination of claim 1 further including a pneumatic hose having an inlet coupled to said outlet of said pneumatic circuit breaker valve means and an outlet, and a quick disconnect valve means having an inlet coupled to said outlet of said pneumatic hose and an outlet adapted to be coupled to a pneumatic tool.

13. The combination of claim 1 wherein said insulative tank means outer wall surface is generally cylindrical, and said shroud means is annular.

14. The combination of claim 1 wherein said shroud means includes a handle portion for facilitating manual transport of said system.

15. The combination of claim 1 wherein said maximum fill capacity is in the range from about 85% to about 90% of said total internal volume of said insulated tank means.

16. The combination of claim 1 wherein said cryogenic fluid is nitrogen.

* * * * *